United States Patent [19]

Fischli

[11] 4,299,273

[45] Nov. 10, 1981

[54] HEAT EXCHANGER, ESPECIALLY RECUPERATOR FOR HIGH TEMPERATURE REACTORS

[75] Inventor: Heinz Fischli, Effretikon, Switzerland

[73] Assignee: Sulzer Brothers Ltd., Winterthur, Switzerland

[21] Appl. No.: 940,779

[22] Filed: Sep. 8, 1978

[30] Foreign Application Priority Data

Sep. 14, 1977 [CH] Switzerland ..... 11217/77

[51] Int. Cl.[3] ..... F28F 1/36

[52] U.S. Cl. ..... 165/78; 165/82; 165/162; 165/DIG. 13

[58] Field of Search ..... 165/145, 146, 76, 78, 165/82, 157, 158, 162, DIG. 13, 154, 155

[56] References Cited

U.S. PATENT DOCUMENTS

| | | | |
|---|---|---|---|
| 2,729,433 | 1/1956 | Berg | 165/78 X |
| 3,294,070 | 12/1966 | Bell | 165/DIG. 13 |
| 3,309,072 | 3/1967 | Cummings | 165/76 X |
| 3,955,620 | 5/1976 | Artemov et al. | 165/162 |
| 4,036,294 | 7/1977 | Ecker | 165/157 X |
| 4,083,695 | 4/1978 | Haese et al. | 165/162 X |
| 4,160,477 | 7/1979 | Roffler | 165/162 X |

FOREIGN PATENT DOCUMENTS

| | | | |
|---|---|---|---|
| 2459094 | 7/1975 | Fed. Rep. of Germany | 165/76 |
| 2640728 | 4/1977 | Fed. Rep. of Germany | 165/145 |
| 286552 | 2/1965 | Netherlands | 165/DIG. 13 |
| 972267 | 10/1964 | United Kingdom | 165/DIG. 13 |

*Primary Examiner*—Stephen Marcus

*Attorney, Agent, or Firm*—Werner W. Kleeman

[57] ABSTRACT

A heat exchanger, especially recuperator for high temperature reactors, comprising a prismatic extending jacket and a multiplicity of elongated hexagonal elements arranged within the jacket and essentially parallel to the primary direction or extent thereof. Each hexagonal element has a central tube and heat transfer surfaces arranged about each central tube and extending axially up to the outer contour or outline of the corresponding hexagonal element. Both ends of the heat transfer surfaces are connected to collectors seated upon the central tube. Each hexagonal element is connected by spacers with its neighboring elements and with analogous spacers spatially fixedly arranged at the region of the jacket laterally bounding the heat exchanger. The spacers have play so that the spacing between the elements and between the elements and the spatially fixedly arranged spacers can alter by the amount of such play. This play is dimensioned such that the sum of the play in any one respective direction over the cross-section of the heat exchanger still positively takes up without constraint the greatest differential expansion arising between the package of hexagonal elements and the spatially fixedly arranged spacers in such direction under extreme operating conditions.

10 Claims, 9 Drawing Figures

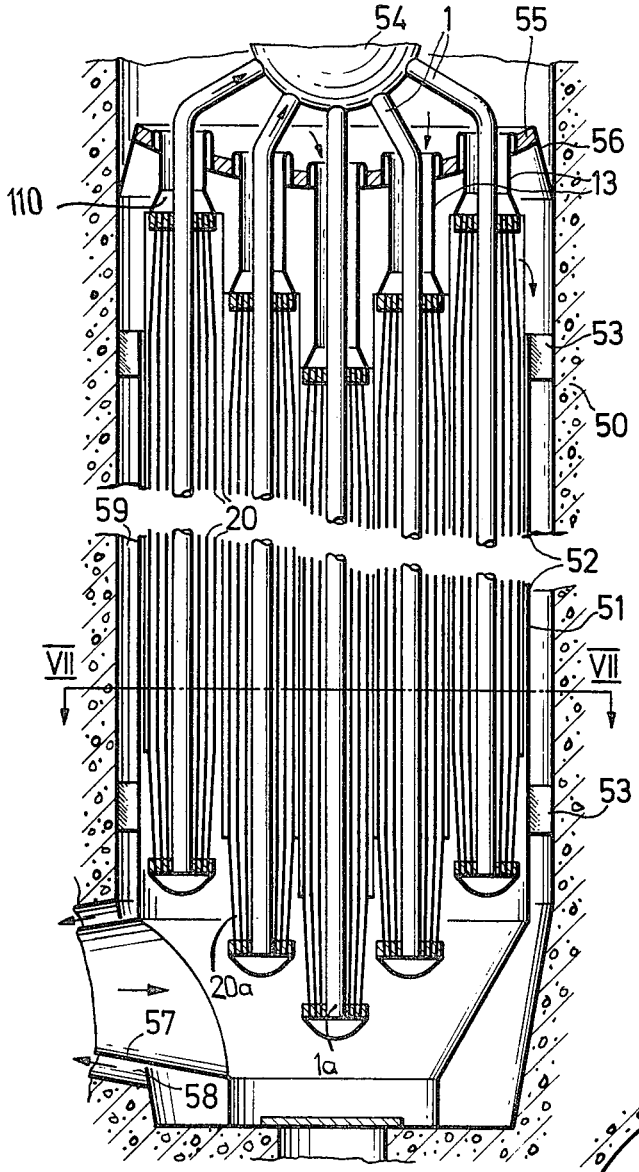
FIG. 6
FIG. 8
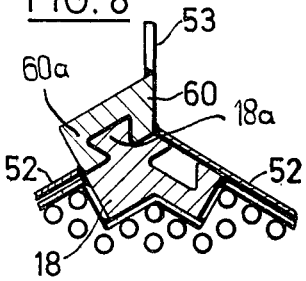
FIG. 9
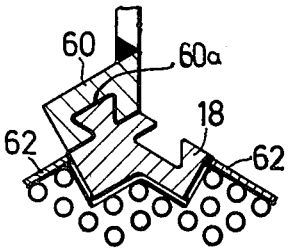
FIG. 7
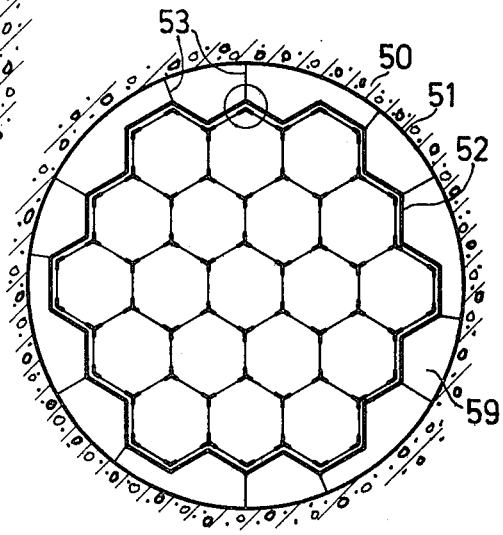

HEAT EXCHANGER, ESPECIALLY RECUPERATOR FOR HIGH TEMPERATURE REACTORS

BACKGROUND OF THE INVENTION

The present invention relates to a new and improved construction of a heat exchanger, especially a recuperator for high temperature reactors. Generally speaking, the heat exchanger of the present invention is of the type comprising a prismatic extending jacket or shell and a multiplicity of elongated hexagonal elements arranged internally of the jacket and essentially parallel to its primary direction i.e., its main direction of extent. Each hexagonal element comprises a central tube or pipe and extending thereabout heat transfer surfaces which extend to the outline or contour of the related hexagonal element, these heat transfer surfaces being connected at both ends with collectors seated at the central tube of the corresponding hexagonal element.

There have already been proposed heat exchangers wherein the hexagonal elements are assembled into a bundle or nest and retained by means of bands or straps or equivalent structure. What is disadvantageous with this construction is that during installation of the heat exchanger into its jacket or shell, which for instance, is accomodated in a blind hole of a concrete pressure tank, localized wide gaps can form during the different operating conditions, owing on the one hand to the different elongation of the bundle of hexagonal elements, and, on the other hand, the jacket or shell. The medium then can undesiredly escape through such wide gaps into a shunt or neighboring pass without having undergone any satisfactory heat exchange.

It is possible to apply tubular-shaped sleeves having sliding seals, sealing strips and so forth to the hexagonal elements in order to avoid the formation of such gaps or to seal such gaps if formed. Yet, the use of such sleeves is however associated with appreciable drawbacks as concerns the space requirements and the material requirements, and furthermore, complications arise owing to the fact that those locations where such sleeves are mounted are only accessable with difficulty and cannot be readily inspected.

SUMMARY OF THE INVENTION

Therefore, with the foregoing in mind it is a primary object of the present invention to provide a new and improved construction of heat exchanger which is not associated with the aforementioned drawbacks and limitations of the prior art proposals.

Another and more specific object of the present invention aims at devising a heat exchanger of the previously mentioned type which is improved in a most simple manner as concerns its construction that there can be effectively avoided or reduced the likelihood of there occurring further gaps which impair the heat exchange.

Yet another significant object of the present invention aims at providing a new and improved construction of heat exchanger which is relatively simple in design, economical to manufacture, affords good heat exchange action, is not readily subject to breakdown or malfunction, and requires a minimum of maintenance and servicing.

Now in order to implement these and still further objects of the invention, which will become more readily apparent as the description proceeds, the heat exchanger of the present development is manifested by the features that each of the hexagonal elements is connected by spacer means with its neighboring elements and with analogous spacer means spatially fixedly arranged at the region of the jacket which laterally bounds the heat exchanger. The spacer means have play so that the spacing between the elements and between the elements and the spatially fixedly arranged spacer means can vary by such play. This play is dimensioned such that the sum of the play in each case in one direction over the cross-section of the heat exchanger is sufficient to take-up without any constraint the largest differential expansion arising between the package of elements, to be considered as rigid, and the spatially fixedly arranged spacer means in such direction under extreme load conditions.

By virtue of this construction there is achieved the beneficial result that both in the case of all loads and transient transition conditions of the heat exchanger as well as also in the shutoff state of the heat exchanger the gap between neighboring elements and possibly between the elements and the jacket does not exceed a predetermined permissible value.

A particularly advantageous embodiment of the invention, especially as concerns the construction and assembly of the heat exchanger, contemplates forming the edges of each hexagonal element by six mutually reinforced longitudinal rails. As to the six longitudinal rails at least three have dovetail sections or profiles which can snap-in and/or snap-out, by means of which, in the assembled condition of the heat exchanger, the hexagonal elements can be interlocked with one another with play and with dovetail sections provided at the spatially fixedly arranged spacer means. The longitudinal rails afford the additional advantage that assembly of the heat exchanger is simplified inasmuch as the rails considerably facilitate the insertion of the hexagonal elements. Furthermore, the longitudinal rails reinforce the hexagonal elements, something favourable in terms of shipping or transportation thereof.

Particular advantages are afforded by a further construction of the invention wherein one collector of each hexagonal element is connected with an infeed line or infeed means by means of an annular or ring channel formed between the central tube and a tube arranged coaxially therewith and the other collector of each hexagonal element is connected via the central tube with an outfeed line or outfeed means. Consequently, the connections of the one medium participating in the heat exchange is arranged at the same end of the heat exchanger.

If according to an embodiment of the invention the heat transfer surfaces are composed of a multiplicity of axially parallel tubes, then this affords advantages from the stand point of fabrication, and furthermore, there prevails the advantage that the design of the heat exchanger can be easily calculated because there are available for such tubular arrangements a great deal of empirical data. If according to another embodiment the heat transfer surfaces are constructed as fins or lamellae, for instance, as disclosed in the commonly assigned U.S. application Ser. No. 729,978, filed Oct. 6, 1976 of Hans Bieri, entitled "Heat Exchanger and a Heat Exchanger Element Therefor" to which reference may be had and the disclosure of which is incorporated herein by reference, then there are realized advantages in the mass production. Moreover, such heat exchanger can be constructed to be extremely compact.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIG. 6 schematically illustrates a vertical sectional view through a heat exchanger constructed according to the invention;

FIG. 7 is a cross-sectional view of the heat exchanger of FIG. 6, taken substantially along the line VII—VII thereof;

FIG. 8 is a detail sectional view of FIG. 7 on an enlarged scale; and

FIG. 9 is a similar detail sectional view of a modified constructional embodiment.

DETAILED DESCRIPTION OF THE PREFERRED EMBODIMENTS

Figure 2:
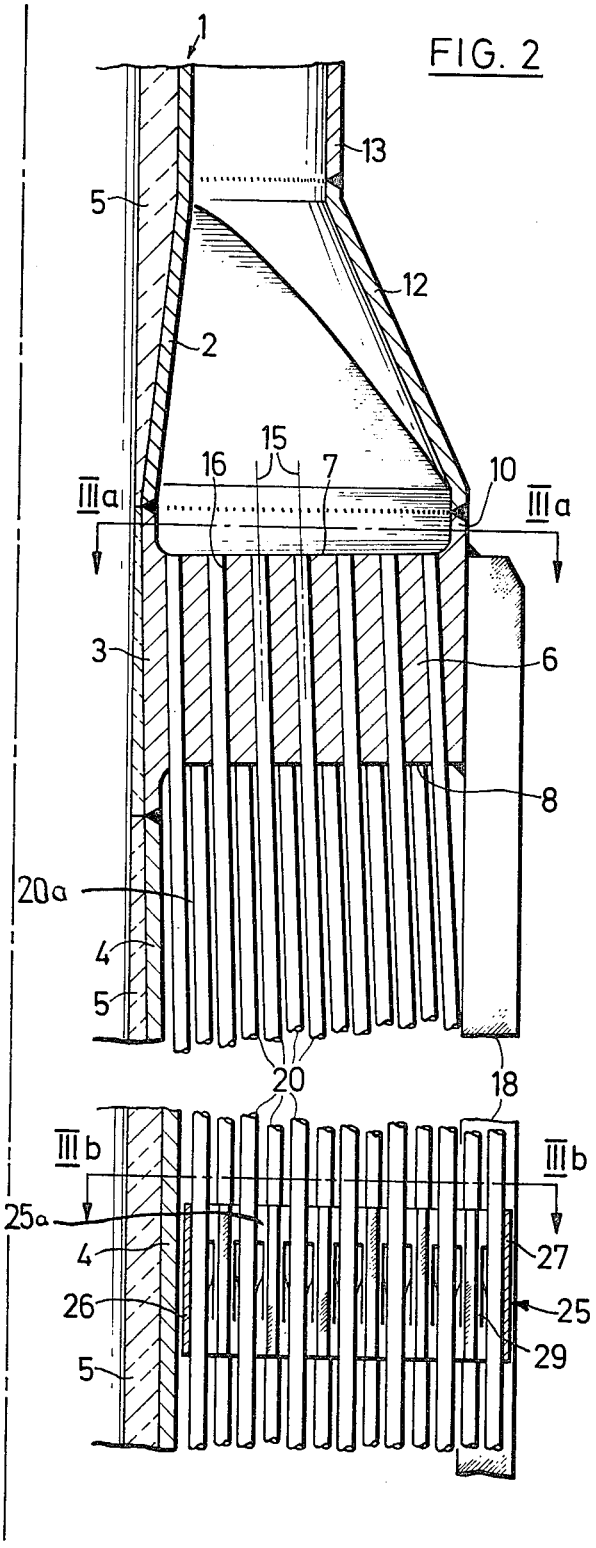
FIG. 2 is an enlarged sectional view through the upper and intermediate region of the hexagonal element, the section being taken substantially along the line II—II of FIG. 3 and with only part of the central tube being shown.
Figure 1:
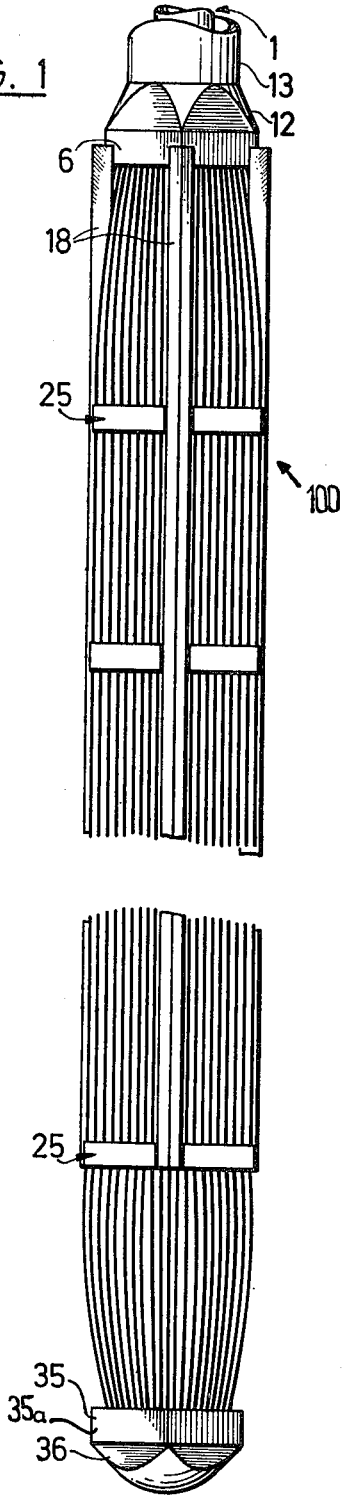
FIG. 1 is a front sectional view of the narrow side of an hexagonal element for a heat exchanger constructed according to the invention.
Figure 3:
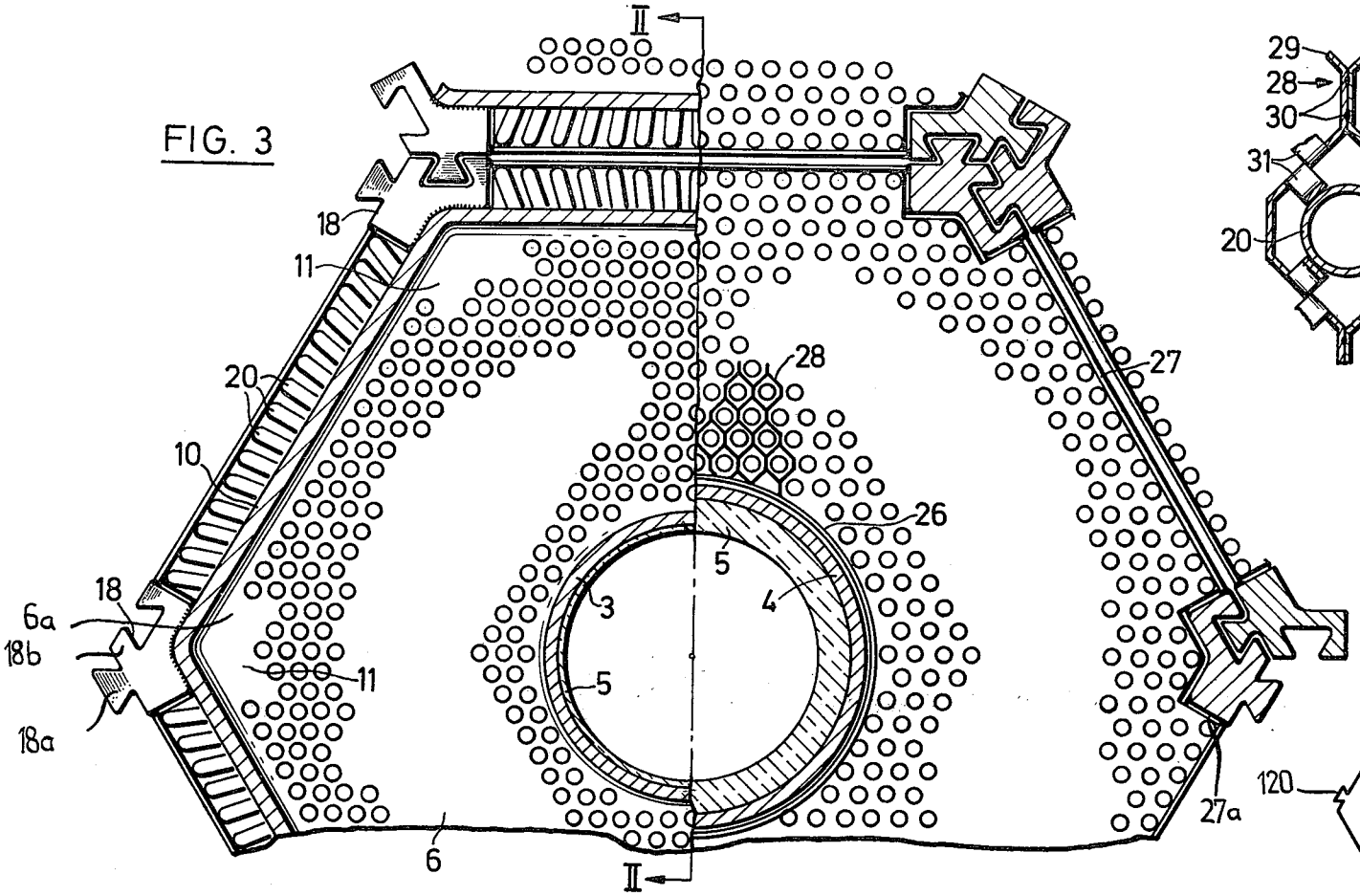
FIG. 3 illustrates at the left-hand side thereof a sectional view, corresponding to the section line III*a*—III*a* of FIG. 2, and at the right-hand side of FIG. 3 there is illustrated a sectional view, taken along the sectional line III*b*—III*b* of FIG. 2, and showing additional marginal portions of two neighboring hexagonal elements.

Describing now the drawings, in FIGS. 1 to 3 there is shown one of the hexagonal elements, generally designated by reference character 100, used to form the heat exchanger. Each such hexagonal element 100 will be seen to comprise a central tube or pipe 1 only a part of which is shown in FIG. 2 and the center line of which is located to the left of FIG. 2 as shown. This central tube or pipe 1 is welded together from three sections 2, 3 and 4 and having over its length different internal diameters. The central tube 1 is lined with insulation 5 which extends over the tube sections 2, 3, and 4 as shown in FIG. 1. The section 3 is structured to provide a tube base or floor 6 having an hexagonal contour or outline. The top 7 and the bottom 8 of the tube base 6, located at the outer surface of the central tube 1 at the region of the tube section 3 are designed to ascend slightly towards the outside. At the top or upper surface 7 there is provided externally thereof a somewhat upwardly protruding edge 10 at which there is welded or otherwise connected a transition element 12 which interconnects the hexagonal edge 10 with a cylindrical tube or pipe 13 which surrounds the central tube or pipe 1, as shown in the upper portion of FIG. 1 to form a ring channel surrounding such central tube. The tube base or bottom 6 is machined, as by drilling, so as to provide a hexagonal grid, and the axes 15 of the formed bores 16 converge with the element axis at a point location externally of the drawing. In the bores 16 of the tube base 6 there are inserted tubes 20 which are sealingly secured therein by means of any conventional fastening technique.

Figure 4:
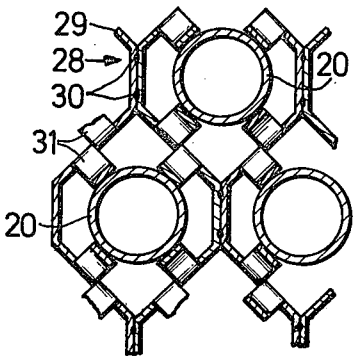
FIG. 4 is a sectional view through a support grid, a portion of which has been schematically shown at the right of the illustration of FIG. 3.

As best seen by referring to FIG. 3, at the six essentially parallel lengthwise extending or longitudinal edges 6*a* of the tube base 6 there is welded or otherwise affixed a respective longitudinal rail 18. The tubes 20 are guided at a number of locations along their length by the support grids 25 or equivalent structure. These support grids 25 consist of an inner ring 26 and an outer frame 27 which essentially follows the hexagonal outline of the hexagonal element 100, but at the region of the six corners such frame is inwardly recessed, as indicated by reference character 27*a*, so as to pass around the longitudinal rails 18. The ring or annular element 26 and the frame 27 are interconnected by a grid or screen 28 shown in enlarged view in FIG. 4. The grid 28 consists of a number of strips 29, for instance formed of sheet metal, which are bent or flexed through an angle of about 45°, bear against one another and are interconnected by spot welds 30. Between the sections of the sheet metal strips 29 which are connected by the spot welds 30 there are formed the tabs or tongues 31 by stamping or otherwise. These tabs or tongues 31 alternately are flexed against the tubes 20 and laterally brace such under a slight pressure. While the ring 26 is only welded at the support grid 28 the frame 27 is attached, as by welding, at the longitudinal rails 18.

The central tube section 4 extends only over the intermediate region of each hexagonal element 100 in substantially cylindrical fashion, its end regions are conically tapered, so that its outer surface follows the course of the innermost row of tubes 20 and the hydraulic radii in the space about the tubes 20 varies as little as possible over the cross-section of the hexagonal element 100. For the same reason the structural material of the ring or annular element 26 and the frame 27 of the support grids 25 are thin. The grid array of the bores 16 in the tube base 6 and the other tube base 35, to be discussed more fully hereinafter, is geometrically similar to the grid of the support grids or screens 25. As a result there are formed in the tube bases 6 and 35, at the region of the hexagonal edges, zones 11 which are free of any holes, as best seen by referring to FIG. 3.

As also recognized by referring to FIG. 3, the longitudinal rails 18 have an angled cross section forming a respective snap-out dovetail section or profile 18*a* and a snap-in dovetail section or profile 18*b*. In the assembled state of the hexagonal elements 100 the dovetail sections 18*a*, 18*b* of neighboring elements engage with play with one another. The longitudinal rails 18 which are welded at the top at the tube base 6 terminate, as best shown by referring to FIG. 1, at the lowermost support grid or screen 25. The tubes 20 piercingly extending through such grid 25 are continued to the tube base or bottom 35 which, like the tube base 6, is welded at the inside at the central tube 1 and at the outside has an hexagonally extending downwardly directed edge 35*a*. Sealingly welded or otherwise fixed to this edge 35*a* is a cup or segmented sphere 36 which arches over the tube base 36 and the mouth 1*a* (see FIG. 6) of the central tube 1.

Fabrication of the hexagonal element 100 is accomplished in the following manner:

Initially the sections 3 and 4 of the central tube 1, which already carry appropriate sections of the insulation 5, and the tube base 35 are welded together after there have been threaded onto the central tube section 4 a number of support grids or screens 25. Now the tubes 20 are introduced through the bores of the one tube base, the corresponding openings 25*a* of all of the support grids 25 and finally introduced into the corresponding bores 16 of the other tube base 6. The support grids 25, while bearing against one another, are supported approximately at half of the height of the central tube section 4. The tubes 20 must be elastically bent for insertion. After all of the tubes have been inserted into the tube bases or bottoms 6 and 35, then the support grids 25 are shifted parallel to themselves in the direction of the lengthwise axis of the hexagonal element and into their final position, the tubes 20 being fixedly retained such that they can not be ejected out of the tube bases 6 and 35. Now the longitudinal rails 18 are inserted into the recesses 27*a* of the frames 27 and such longitudinal rails 18 welded or otherwise suitably connected with the frames 27 and also the tube base 6. Thereafter the tubes 20 are rolled, welded or otherwise sealingly connected at both ends at the tube bases 6 and 35, sometimes also referred to as tube plates 6 and 35. Finally, at the inner edge of the tube base or plate 6 there is welded the central tube section 2 and at the outer edge 10 there is welded the transition element 12 and at the outer edge of the tube base or plate 35 there is welded the cup or segmented sphere 36. Hence, now the hexagonal element 100 is ready to be checked for tightness and can then be assembled to form the heat exchanger.

Now in FIGS. 6 and 7 there is shown how a heat exchanger assembled from the described hexagonal elements 100 is arranged in a concrete pressure vessel 50 whose walls surrounding the heat exchanger are lined with a sheet metal lining 51. Within the lining 51 there is provided a jacket 52 surrounding the heat exchanger. This jacket or shell 52, as shown in FIG. 7, extends prismatically in accordance with the outer contour or outline of the heat exchanger. The hexagonal elements 100 extend in the direction of the lengthwise axis, i.e., the primary extent of the jacket or shell 52 and essentially parallel to such primary direction of extent. Further, this jacket or shell 52 is connected by means of radial webs 53 with the lining 51, and between such lining 51 and the jacket or shell 52 there is formed a substantially ring-shaped channel 59 which, during operation, has downwardly flowing therethrough the medium which flow around the hexagonal elements 100. Within the jacket 52 there are arranged, as mentioned, the hexagonal elements 100. These hexagonal elements 100 are connected by means of their central tubes 1 at a substantially spherical-shaped collector 54 and by means of the cylindrical tubes 13 at a downwardly domed or arched plate 55. The domed plate 55 is connected by means of a truncated cone-shaped section 56 formed of sheet metal with the lining 51. Above the tube plate 55 there is infed in a suitable and therefore not further shown manner the medium which flows in the tubes 20 of the hexagonal elements 100, this medium, after flowing through the tubes 20, arriving via the central tubes 1 at the collector 54.

At its lower end the jacket or shell 52 is inwardly conically drawn and provided with a radial sheet metal channel 57 through which there is infed the medium to the heat exchanger and which flows around the hexagonal elements 100. Externally of the sheet metal channel there is formed a ring-shaped or annular channel 58 with which there communicates the channel 59 located between the jacket or shell 52 and the lining 51.

All of the hexagonal elements 100 are interconnected with one another while maintaining a certain play by means of the dovetail sections 18*a*, 18*b* shown in FIG. 3. The outermost row of the hexagonal elements 100 of the heat exchanger is connected by means of its longitudinal or lengthwise extending rails 18, located at the outside in relation to the heat exchanger, with the stationarily mounted jacket or shell 52 by means of the longitudinal rails 60, as shown in FIG. 8. The longitudinal or lengthwise extending rails 60 are connected on the one hand with the jacket or shell 52 and on the other hand with the webs 53. These longitudinal rails 60 have snap-in dovetail sections or profiles 60*a* which, in the assembled condition, coact with the snap-out dovetail profiles or sections 18*a* of the longitudinal rails 18, there likewise being provided a certain play which has not been shown in FIG. 8 to simplify the illustration, however corresponds to that of FIG. 3.

In the embodiment according to FIG. 9 the jacket or shell 52 is not stationarily mounted, rather constitutes a component of the outermost row of hexagonal elements 100. For this purpose there are welded between in each case two outer situated longitudinal rails 18 sheet metal elements 62 forming jacket sections which also during assembly of the heat exchanger can be inserted together with the hexagonal elements 100 into the longitudinal rails 60 attached at the lining 51.

With the arrangement of the hexagonal elements 100, staggered in elevation, as shown in FIG. 6, the hexagonal element 100 located at the center of the heat exchanger has relatively poor outflow conditions at its outside. In order to prevent this there can be arranged at the location of the central hexagonal element 100 a filler body, for instance a downwardly closed hexagonal tube. At the outermost row of hexagonal elements there prevail at the inflow side of the medium flowing about the elements relatively unfavourable conditions. These flow conditions can be improved if the jacket or shell 52 is somewhat widened in a limited elevational region or zone.

During operation of the heat exchanger as a recuperator of a high temperature reactor hot low pressure medium flows out of the channel 57 into the longitudinal spaces 20*a* formed between the tubes 20, the support grids 25 producing turbulence in the desired manner. This low pressure medium after having been cooled then departs from the aforementioned longitudinal spaces 20*a* between the uppermost one of the support grids 25 and the tube base 6 and then arrives at the ring or annular channel 59 where it flows downwards. The high pressure medium which is to be heated-up flows through the cylindrical tubes or pipes 13 into the ring-shaped distributer spaces 110 formed between the central tube section 2 and the transition element 12 above each respective associated tube base 6, from that location flows through the tubes 20 to the collecting spaces formed by the cups or segmented spheres 36 and the tube bases 35, and finally flows upwardly through the central tubes 1 into the collector 54. The heat transfer from the hot high pressure medium within the central tubes 1 at the supporting material of the central tubes is reduced by the insulation 5, the thickness of which is optimized, so as to afford small pressure drop and small thermal losses.

The play in the dovetail sections 18*a*, 18*b* of the longitudinal rails 18 and the dovetail sections 60*a* of the longitudinal rails 60 corresponds approximately to the difference in the expansion prevailing during operation and standstill of a hexagonal element, so that such expansion differences do not tend to summate at one location, rather are distributed at all sections between the hexagonal elements. The longitudinal rails 18 and 60, particularly at the region of the dovetail sections or joints, can be protected against fretting corrosion and undesired welding together by applying special materials, such as for instance chromium carbide. The same measures also are useful for the tabs or tongues 31 of the support grids 25.

In order to facilitate the insertion of the hexagonal elements 100 it is possible to sectionally interrupt over their length the snap-out parts of the dovetail joints or sections. Additionally, the play at the snap-in dovetail sections or regions can be differently configured over the length of the longitudinal rails in a manner such that during insertion into the final position there is present a smaller value of the play than at the last part of the insertion path prior to reaching the final position. For the same purpose the portions of the dovetail also can be formed to have a slight taper.

Figure 5:
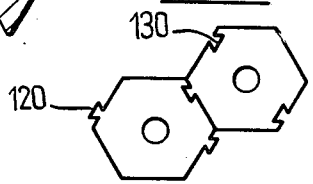
FIG. 5 schematically illustrates an embodiment having a minimum number of dovetail joints.

To reduce the friction during assembly it is also possible to reduce the number of dovetail joints or connections in the extreme case to the schematically illustrated embodiment as shown in FIG. 5. With this embodiment a heat exchanger has two types of hexagonal elements, of which the one has two snap-out dovetail sections or profiles 120 and one snap-in dovetail section or profile 130 and the other has one snap-out dovetail section or profile 120 and two snap-in dovetail sections or profiles 130.

Finally, it is mentioned that the bores 16 at the tube bases 6 and 35 can be preferably convergingly constructed to such a degree that independent of the operating conditions the tubes are simply bent, i.e., without any turning point. Consequently, the bending stress of the tubes is maintained small.

While there are shown and described present preferred embodiments of the invention, it is to be distinctly understood that the invention is not limited thereto, but may be otherwise variously embodied and practiced within the scope of the following claims. Accordingly,

What I claim is:

1. A heat exchanger, especially a recuperator for high temperature reactors, comprising:

a substantially prismatic jacket having a primary direction of extent;

a multiplicity of elongated hexagonal elements arranged within the jacket and essentially parallel to the primary direction of extent thereof;

each hexagonal element having a central tube and means defining heat transfer surfaces arranged about each central tube;

said means defining said heat transfer surfaces having opposed ends and extending axially about the central tube and up to the region of the outer contour of the related hexagonal element;

respective collectors seated upon opposite ends of said central tube and connected with respective opposed ends of said means defining the heat transfer surfaces;

spacer means spatially fixedly arranged at the region of the jacket;

spacer means for connecting each hexagonal element with its neighboring hexagonal elements and with said spacer means spatially fixedly arranged at the region of the jacket laterally bounding the heat exchanger;

said spacer means being structured so as to have play such that the spacing between the hexagonal elements and between the hexagonal elements and the spatially fixedly arranged spacer means can alter by the amount of such play;

said play being sized such that the sum of the play in any one predetermined respective direction over the cross-section of the heat exchanger takes-up without constraint the greatest differential expansion between the hexagonal elements and the spatially fixedly arranged spacer means in such direction under extreme operating conditions of the heat exchanger;

each hexagonal element having edges formed by six mutually reinforced longitudinal rails; and said spacer means of said hexagonal elements comprising at least three of said longitudinal rails having dovetail joints which engage, in the assembled condition of the heat exchanger, with play with one another and with dovetail joints provided at the spatially fixedly arranged spacer means.

2. The heat exchanger as defined in claim 1, wherein:

said longitudinal rails of each hexagonal element are attached at the periphery of at least one of both collectors.

3. The heat exchanger as defined in claim 1, wherein:

said hexagonal elements are individually insertable in a stationarily mounted jacket defining said prismatic jacket;

said stationarily mounted jacket having analogous spacer means as the axially extending longitudinal rails having the dovetail joints and mounted at its inner side.

4. A heat exchanger, especially a recuperator for high temperature reactors, comprising:

a substantially prismatic jacket having a primary direction of extent;

a multiplicity of elongated hexagonal elements arranged within the jacket and essentially parallel to the primary direction of extent thereof;

each hexagonal element having a central tube and means defining heat transfer surfaces arranged about each central tube;

said means defining said heat transfer surfaces having opposed ends and extending axially about the central tube and up to the region of the outer contour of the related hexagonal element;

respective collectors seated upon opposite ends of said central tube and connected with respective opposed ends of said means defining the heat transfer surfaces;

spacer means spatially fixedly arranged at the region of the jacket;

spacer means for connecting each hexagonal element with its neighboring hexagonal elements and with said spacer means spatially fixedly arranged at the region of the jacket laterally bounding the heat exchanger;

said spacer means being structured so as to have play such that the spacing between the hexagonal elements and between the hexagonal elements and the spatially fixedly arranged spacer means can alter by the amount of such play;

said play being sized such that the sum of the play in any one predetermined respective direction over the cross-section of the heat exchanger takes-up without constraint the greatest differential expansion between the hexagonal elements and the spatially fixedly arranged spacer means in such direction under extreme operating conditions of the heat exchanger; and said means defining said heat transfer surfaces of each hexagonal element possess a substantially lamella-like construction.

5. A heat exchanger, especially a recuperator for high temperature reactors, comprising:

a substantially prismatic jacket having a primary direction of extent;

a multiplicity of elongated hexagonal elements arranged within the jacket and essentially parallel to the primary direction of extent thereof;

each hexagonal element having a central tube and means defining heat transfer surfaces arranged about each central tube;

said means defining said heat transfer surfaces having opposed ends and extending axially about the central tube and up to the region of the outer contour of the related hexagonal element;

respective collectors seated upon opposite ends of said central tube and connected with respective opposed ends of said means defining the heat transfer surfaces;

spacer means spatially fixedly arranged at the region of the jacket;

spacer means for connecting each hexagonal element with its neighboring hexagonal elements and with said spacer means spatially fixedly arranged at the region of the jacket laterally bounding the heat exchanger;

said spacer means being structured so as to have play such that the spacing between the hexagonal elements and between the hexagonal elements and the spatially fixedly arranged spacer means can alter by the amount of such play;

said play being sized such that the sum of the play in any one predetermined respective direction over the cross-section of the heat exchanger takes-up without constraint the greatest differential expansion between the hexagonal elements and the spatially fixedly arranged spacer means in such direction under extreme operating conditions of the heat exchanger;

said means defining said heat transfer surfaces of each hexagonal element comprising a multiplicity of substantially axially parallel tubes;

each hexagonal element including a pair of substantially ring-shaped tube bases sealingly connected at the central tube;

said tubes forming said heat exchange surfaces of each hexagonal element terminating at said ring-shaped tube bases;

each tube base forming a part of an associated one of said collectors;

support grid means provided for each hexagonal element for laterally guiding the intermediate region of the tubes of each hexagonal element;

said support grid means extending perpendicular to the lengthwise axis of the associated hexagonal element;

each hexagonal element having edges formed by six mutually reinforced longitudinal rails;

said spacer means of said hexagonal elements comprising at least three of said longitudinal rails having dovetail joints which engage, in the assembled condition of the heat exchanger, with play with one another and with dovetail joints provided at the spatially fixedly arranged spacer means; and said support grid means of each hexagonal element being fixedly connected with the longitudinal rails of the associated hexagonal element.

6. A heat exchanger, especially a recuperator for high temperature reactors, comprising:

a substantially prismatic jacket having a primary direction of extent;

a multiplicity of elongated hexagonal elements arranged within the jacket and essentially parallel to the primary direction of extent thereof;

each hexagonal element having a central tube and means defining heat transfer surfaces arranged about each central tube;

said means defining said heat transfer surfaces having opposed ends and extending axially about the central tube and up to the region of the outer contour of the related hexagonal element;

respective collectors seated upon opposite ends of said central tube and connected with respective opposed ends of said means defining the heat transfer surfaces;

spacer means spatially fixedly arranged at the region of the jacket;

spacer means for connecting each hexagonal element with its neighboring hexagonal elements and with said spacer means spatially fixedly arranged at the region of the jacket laterally bounding the heat exchanger;

said spacer means being structured so as to have play such that the spacing between the hexagonal elements and between the hexagonal elements and the spatially fixedly arranged spacer means can alter by the amount of such play;

said play being sized such that the sum of the play in any one predetermined respective direction over the cross-section of the heat exchanger takes-up without constraint the greatest differential expansion between the hexagonal elements and the spatially fixedly arranged spacer means in such direction under extreme operating conditions of the heat exchanger;

said means defining said heat transfer surfaces of each hexagonal element comprising a multiplicity of substantially axially parallel tubes; and insulating means for insulating the central tube of each hexagonal element.

7. The heat exchanger as defined in claim 6, wherein:

said insulation means is arranged at an inner surface of the central tube.

8. The heat exchanger as defined in claim 7, wherein:

the outer contour of the insulated central tube essentially follows the course of an innermost row of tubes of the associated hexagonal element.

9. The heat exchanger as defined in claim 8, wherein:

said insulation means has a varying wall thickness over its length.

10. The heat exchanger as defined in claim 9, wherein:

the inner diameter of the insulation means is essentially constant over its entire length.

* * * * *